US008207660B2

(12) United States Patent
Reingruber

(10) Patent No.: US 8,207,660 B2
(45) Date of Patent: Jun. 26, 2012

(54) LUMINAIRE WITH ECCENTRIC CHANNEL DESIGN

(75) Inventor: Fabian Reingruber, Munich (DE)

(73) Assignee: Osram AG, Munich (DE)

( * ) Notice: Subject to any disclaimer, the term of this patent is extended or adjusted under 35 U.S.C. 154(b) by 103 days.

(21) Appl. No.: 12/640,014

(22) Filed: Dec. 17, 2009

(65) Prior Publication Data

US 2010/0156262 A1 Jun. 24, 2010

(30) Foreign Application Priority Data

Dec. 19, 2008 (DE) ..... 20 2008 016 867

(51) Int. Cl.
*H01J 61/56* (2006.01)
*F21V 19/00* (2006.01)

(52) U.S. Cl. ..... 313/498; 362/238; 362/249.02; 362/655; 257/99

(58) Field of Classification Search ..... 313/46, 313/512

See application file for complete search history.

(56) References Cited

U.S. PATENT DOCUMENTS

| | | | | |
|---|---|---|---|---|
| 6,227,679 | B1 * | 5/2001 | Zhang et al. | 362/236 |
| 7,275,839 | B2 * | 10/2007 | Coushaine et al. | 362/231 |
| 7,367,692 | B2 * | 5/2008 | Maxik | 362/307 |
| 2005/0169812 | A1 * | 8/2005 | Helf et al. | 422/123 |
| 2008/0232119 | A1 * | 9/2008 | Ribarich | 362/373 |
| 2009/0034283 | A1 * | 2/2009 | Albright et al. | 362/545 |

FOREIGN PATENT DOCUMENTS

| | | | |
|---|---|---|---|
| DE | 10052380 | A1 | 10/2001 |
| DE | 10050817 | A1 | 5/2002 |
| DE | 202006018985 | U1 | 5/2007 |
| DE | 102006001976 | A1 | 8/2007 |
| DE | 202007014421 | U1 | 2/2008 |
| GB | 2363239 | B | 8/2004 |

OTHER PUBLICATIONS

English language abstract for DE 10050817 A1.
English language abstract for DE 20 2007 014 421 U1.
English language abstract for DE 20 2006 018 985 U1.
English language abstract for DE 10 2006 001 976 A1.

* cited by examiner

*Primary Examiner* — Sikha Roy

(57) ABSTRACT

A luminaire is specified with a printed circuit board having at least one light emitting diode, the printed circuit board having a cutout for engaging with a holding element, the cutout positioning the printed circuit board in a fashion locked against rotation with the holding element.

16 Claims, 1 Drawing Sheet

LUMINAIRE WITH ECCENTRIC CHANNEL DESIGN

CROSS-REFERENCE TO RELATED APPLICATION

This application claims priority to German Patent Application Serial No. 20 2008 016 867.8, which was filed Dec. 19, 2008, and is incorporated herein by reference in its entirety.

TECHNICAL FIELD

Various embodiments relate to a luminaire or lamp, e.g. a retrofit luminaire or a retrofit lamp.

BACKGROUND

A luminaire or lamp including at least one light emitting diode for use as a retrofit luminaire has, for example, a primary side and a secondary side. The primary side serves for converting the line voltage and for controlling the secondary side, which has at least one light emitting diode.

The secondary side can be designed in a fashion at least partially spatially separated from the primary side, and has a connection to a printed circuit board that includes the primary side.

SUMMARY

Various embodiments provide a luminaire. The luminaire may include a printed circuit board having at least one light emitting diode; the printed circuit board having a cutout for engaging with a holding element; the cutout positioning the printed circuit board in a fashion locked against rotation with the holding element.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

The following detailed description refers to the accompanying drawings that show, by way of illustration, specific details and embodiments in which the invention may be practiced.

The approach presented here may enable an efficient, quick and fault-tolerant mounting of a luminaire. The approach presented also renders possible a luminaire that has a high fault tolerance owing to the fault-tolerant mounting.

Figure 1:
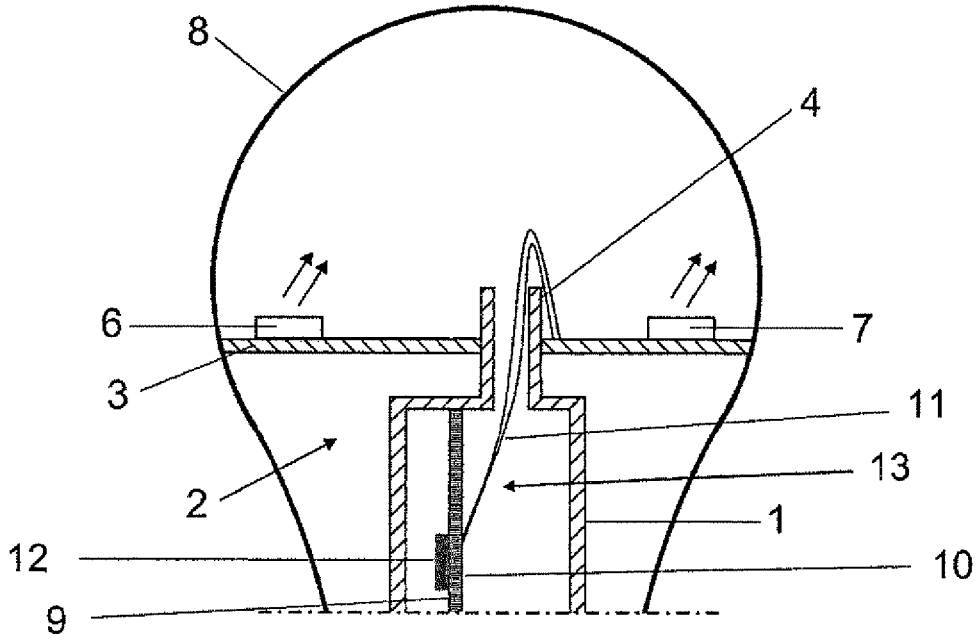
FIG. 1 shows by way of example a luminaire, for example in the form of an incandescent bulb, for holding in a mount, the luminaire having a holding element, a printed circuit board with light emitting diodes and a heat sink, and a further printed circuit board having a component attached thereto, these being arrange locked against mutual rotation in the luminaire.

FIG. 1 shows by way of example a luminaire for example in the form of an incandescent bulb, for holding in a mount.

An annular printed circuit board 3 is, for example, designed as an aluminum core printed circuit board and fitted to hold light emitting diodes 6 and 7. The printed circuit board 3 has an eccentric cutout.

A holding element 1, for example, in the form of a plastic housing, has a channel 4 that can be designed as a projection, the channel 4 being guided at least partially through the cutout in the printed circuit board 3.

Also provided is a heat sink 2 that is thermally coupled to the printed circuit board 3. By way of example, the heat sink 2 at least partially fills up the part below the printed circuit board 3 that is not required by the holding element 1. The heat sink 2 is also advantageously connected to the wall of the luminaire such that the heat sink 2 can dissipate heat to the outside via the luminaire, in particular via the mounting of the luminaire.

When the luminaire is being mounted, it can, for example, be ensured by the eccentric cutout in the printed circuit board 3 that the holding element 1, the heat sink 2 and the printed circuit board 3 can be mutually positioned in a fashion locked against rotation and clearly defined inside the luminaire.

The luminaire further has a luminous dome 8 above the light emitting diodes 6 and 7 that can be transparent or at least partially opaque.

The holding element 1 is suitable, for example, for holding a further printed circuit board 13 with a primary side 9 and a secondary side 10, the primary side 9 and the secondary side 10 being separated from each other by a locking state region. The secondary side 10 on the further printed circuit board 13 has connections 11 for connection to the printed circuit board 3, for example by means of connections 11 or wires guided through the channel 4. In addition to the light emitting diodes 6, 7, it is also possible to provide components for driving the light emitting diodes 6, 7 on the printed circuit board 3.

For example, a primary side 9 of the further printed circuit board 13 includes a transformer 12, for converting the line voltage in order to operate the light emitting diodes 6, 7.

The primary side 9 and the secondary side 10 are galvanically isolated from one another, and air gaps and creep sections are taken into account here as appropriate.

Furthermore, the luminaire can have an optical system for the controlled output of the light emitted by the at least one light emitting diode 6, 7. The optical system can be provided per light emitting diode 6, 7, and/or arranged at least partially in or on the luminous dome 8.

The channel 4 is may be provided in order to connect to the printed circuit board 3 a circuit arrangement, for example the further printed circuit board named above, which can be fitted or provided in the holding element.

Figure 2:
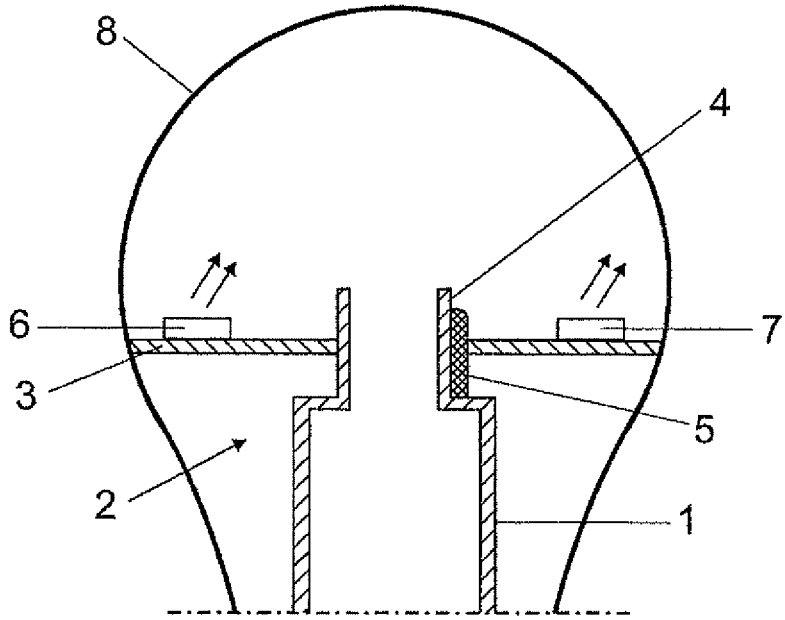
FIG. 2 shows an alternative embodiment of a luminaire, for example in the form of an incandescent bulb, for holding in a mount.

FIG. 2 shows, by way of example, another luminaire, for example in the form of an incandescent bulb, for holding in a mount.

The reference numerals correspond in part to the reference numerals mentioned in connection with FIG. 1. Reference is made to FIG. 1 regarding their explanation.

The channel 4 shown in FIG. 2 is designed substantially in the middle of the luminaire, but it is, for example, designed asymmetrically such that an engagement with the printed circuit board 3 of appropriately complementary design can be performed in a fashion locked against rotation, that is to say in a fashion determined with reference to their mutual positions. Thus, for example, the channel 4 can have a groove or a projection 5 for engaging in a complementary projection or groove in the printed circuit board 3.

In FIG. 2, as well, the heat sink 2, the printed circuit board 3 and the holding element 1 are mutually positioned in the luminaire in a fashion locked against rotation, or are positioned in a fashion locked against rotation with the luminaire mounted.

The approach presented here further has the advantage that an effective antirotation protection can be implemented cost-effectively and efficiently, without the need for additional space, without significant outlay on production and without appreciable extra costs.

The luminaire can be designed as a retrofit luminaire and have a base for engaging in a standardized mount such as is customary, for example, with incandescent bulbs.

The luminaire can also have a multiplicity of light emitting diodes. These may be arranged on the printed circuit board 3.

Various embodiments improve mountability of the luminaire and, for example, provide an efficient antirotation lock of components of the luminaire.

Various embodiments provide a luminaire with a printed circuit board having at least one light emitting diode, the printed circuit board having a cutout for engaging with a holding element, it being possible with the aid of the cutout to position the printed circuit board in a fashion locked against rotation with the holding element.

Furthermore, various embodiments provide a luminaire with a printed circuit board having at least one light emitting diode, the printed circuit board having a cutout for engaging with a holding element, the cutout positioning the printed circuit board in a fashion locked against rotation with the holding element.

In various embodiments, the luminaire always is or can be assembled in the same way, and thus, an efficient and cost-effective antirotation lock is implemented.

It may be noted here that the light emitting diode can be any semiconductor luminous element or any semiconductor emitter.

In various embodiments, the cutout is provided eccentrically in relation to an axis of symmetry of the luminaire.

In various embodiments, the printed circuit board and the holding element are positioned inside the luminaire in a fashion locked against mutual rotation owing to the eccentric placing of the cutout.

In various embodiments, the holding element can be or is arranged substantially perpendicular to the printed circuit board.

In various embodiments, the holding element has a projection in the form of a channel for at least partially engaging with the printed circuit board.

In various embodiments, the channel can serve to connect the printed circuit board to a circuit arrangement provided in the holding element. By way of example, it is possible to guide through the channel wires that connect a secondary side on a printed circuit board arranged in the holding element to the printed circuit board having the light emitting diodes.

In various embodiments, the cutout has an asymmetric shape for engaging with the holding element.

In various embodiments, the cutout has a projection and/or a groove for positioning the holding element in a fashion locked against rotation.

In various embodiments, a heat sink is or can be arranged at least partially between the holding element and the printed circuit board, the holding element positioning the heat sink in a fashion locked against rotation with the holding element and with the printed circuit board.

In various embodiments, the printed circuit board is an aluminum core printed circuit board.

In various embodiments, the cutout is an opening, e.g. a round or a square opening.

In various embodiments, the holding element is a holding element for a circuit arrangement having a primary side for operating at least one light emitting diode.

In various embodiments, the circuit arrangement has a further printed circuit board with a secondary side and the primary side, the primary side and the secondary side being separated from one another by a locking state region.

In various embodiments, the cutout is set up for connecting at least one light emitting diode to the circuit arrangement.

In various embodiments, the printed circuit board is a substantially annular printed circuit board.

In various embodiments, the luminaire has a base for holding in a mount.

In various embodiments, the luminaire has the form of an incandescent bulb and can be introduced as a retrofit luminaire into a mount provided for an incandescent bulb.

List of Reference Numerals

1 Holding element
2 Heat sink
3 Printed circuit board
4 Channel
5 Notch
6 Light emitting diode
7 Light emitting diode
8 Luminous dome While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A luminaire, comprising:

a printed circuit board having at least one light emitting diode; the printed circuit board having a cutout for engaging with a holding element; the cutout positioning the printed circuit board in a fashion locked against rotation with the holding element;

wherein the cutout is provided eccentrically in relation to an axis of symmetry of the luminaire.

2. The luminaire as claimed in claim 1, wherein the holding element can be or is arranged substantially perpendicular to the printed circuit board.

3. The luminaire as claimed in claim 1, wherein the holding element has a projection in the form of a channel for at least partially engaging with the printed circuit board.

4. The luminaire as claimed in claim 1, wherein the cutout has an asymmetric shape for engaging with the holding element.

5. The luminaire as claimed in claim 1, wherein the cutout comprises at least one of a projection and a groove for positioning the holding element in a fashion locked against rotation.

6. The luminaire as claimed in claim 1, wherein a heat sink is or can be arranged at least partially between the holding element and the printed circuit board, the holding element positioning the heat sink in a fashion locked against rotation with the holding element and with the printed circuit board.

7. The luminaire as claimed in claim 1, wherein the printed circuit board is an aluminum core printed circuit board.

8. The luminaire as claimed in claim 1, wherein the cutout is an opening.

9. The luminaire as claimed in claim 8, wherein the opening is an opening selected from a group consisting of:

a round opening; and a square opening.

10. The luminaire as claimed in claim 1, wherein the holding element is a holding element for a circuit arrangement comprising a primary side for operating at least one light emitting diode.

11. The luminaire as claimed in claim 1, wherein the circuit arrangement further comprises a further printed circuit board with a secondary side and a primary side disposed within the holding element.

12. The luminaire as claimed in claim 1, wherein the cutout is configured to connect at least one light emitting diode to a circuit arrangement.

13. The luminaire as claimed in claim 1, wherein the printed circuit board is a substantially annular printed circuit board.

14. The luminaire as claimed in claim 1, in which the luminaire has a base for holding in a mount.

15. The luminaire as claimed in claim 1, wherein the luminaire has the form of an incandescent bulb and can be introduced as a retrofit luminaire into a mount provided for an incandescent bulb.

16. A luminaire, comprising:

a printed circuit board comprising at least one light emitting diode;

the printed circuit board having an eccentric cutout for engaging with a holding element;

it being possible with the aid of the eccentric cutout to position the printed circuit board in a fashion locked against rotation with the holding element.

* * * * *